United States Patent [19]

Grass

[11] Patent Number: 4,881,297

[45] Date of Patent: Nov. 21, 1989

[54] FURNITURE HINGE WITH SNAP-IN MECHANISM

[75] Inventor: Alfred Grass, Höchst, Austria

[73] Assignee: Grass AG, Hochst/Vlbg., Austria

[21] Appl. No.: 250,346

[22] Filed: Sep. 28, 1988

[30] Foreign Application Priority Data

Oct. 6, 1987 [DE] Fed. Rep. of Germany ..... 3733700

[51] Int. Cl.[4] ..... E05D 7/12

[52] U.S. Cl. ..... 16/258; 16/382; 16/DIG. 43

[58] Field of Search ..... 16/252, 257, 258, 259, 16/232, 382, DIG. 43

[56] References Cited

U.S. PATENT DOCUMENTS

| | | | |
|---|---|---|---|
| 4,620,343 | 11/1986 | Grass | 16/382 |
| 4,674,148 | 6/1987 | Salice | 16/258 |
| 4,750,238 | 6/1988 | Röck et al. | 16/DIG. 43 |
| 4,799,289 | 1/1989 | Grass | 16/258 |
| 4,800,622 | 1/1989 | Röck et al. | 16/382 |

FOREIGN PATENT DOCUMENTS 3624237 9/1987 Fed. Rep. of Germany ..... 16/382

*Primary Examiner*—Richard K. Seidel
*Assistant Examiner*—William Scott Andes

[57] ABSTRACT

A furniture hinge with a snap-in mechanism for locking the hinge arm connected to a door onto a base plate fastened to the furniture article, the hinge comprising an articulation housing having swivel arms projecting therefrom, the free ends of the swivel arm supporting a cover bracket to which are affixed an adjusting plate and a mounting plate. The base plate has a locked connection with the mounting plate. The front side of the mounting plate has a hook-shaped supporting surface in a nonpositive engagement with a wedge surface of the base plate. A spring mounted rocker is formed on the end of the mounting plate and has backwardly curved locking shoulders with gripping projections that lock on upwardly curved sliding surfaces formed on the base plate.

8 Claims, 8 Drawing Sheets

10
8
9
8
7

8
9
6
7
2
1
12
2
3
4

9
8
10
8
9
1
40
4
3
4
40

11
17
19
24
23
30
49
32
18
13
14
15
16

FURNITURE HINGE WITH SNAP-IN MECHANISM

BACKGROUND OF THE INVENTION

1. Field of the Invention

This invention relates to a furniture hinge with a snap-in mechanism, more particularly to a furniture hinge provided on the inner side of furniture between the door and the furniture article. An articulation housing having projecting swivel arms as positioned in a recess on the inner side of a door. One or more swivel arms extend from the articulation housing to a cover bracket which houses an adjusting plate and a mounting plate. The mounting plate is connected with a base plate that is attached to the furniture unit.

2. Description of the Prior Art

Doors are usually delivered separately from the furniture units to which they append. Thus, a part of the connecting hinge is on the door while the other part is located on the inner side of the furniture article. When setting up the furniture, the user must mount the door or other type of hinged closure in a suitable way thereby connecting the two parts of the furniture hinge. One commonly used furniture hinge enables the connection of the hinge parts by sliding them onto each other and then locking them in place. A drawback with this construction is that it requires a relatively long sliding distance of the hinge parts with respect to each other and longitudinal guides which makes mounting the door on the furniture article difficult. Moreover, this type of longitudinal guide must be designed with relatively high precision which increases the overall cost of such hinges.

SUMMARY OF THE INVENTION

The present invention is a furniture hinge with a snap-in mechanism for locking the hinge arm connected to a door onto a base plate fastened to the furniture article. The hinge includes an articulation housing having swivel arms projecting therefrom, the free ends of which support a cover bracket to which are secured an adjusting plate and a mounting plate. The base plate has a locked connection with the mounting plate. The front side of the mounting plate has a hook-shaped supporting surface engaging a wedge surface of the base plate. A spring mounted rocker is positioned on the end of the mounting plate and has backwardly curved locking shoulders with gripping projections that lock on upwardly curved sliding surfaces formed on the base plate.

An object of the present invention is therefore to develop a furniture hinge of the type described of a structurally simple design which will facilitate self-locking when the hinge parts are engaged and will impede disengagement of the hinge parts from each other.

The essential features of the present invention enable the base plate and the mounting plate to be brought together in nearly a vertical manner and thereafter locked in place. The mounting plate is provided on one side with only a hook-shaped supporting surface and on the other side with a spring-mounted rocker having a gripping projection. Once the mounting plate is hooked to the base plate, it can be merely clipped vertically onto the base plate.

The present invention avoids the slide-on system ordinarily used for hinge parts which considerably reduces manufacturing costs because of the elimination of guides. In one embodiment, the rocker passes through an opening of a wing in the mounting plate with an offset gripping wing and is held in position by a bushing spring. The rocker is advantageously provided with an outwardly projecting actuating bracket which enables separation of the hinge parts from each other through a slight lift of the bracket.

Gripping projections of the rocker are set approximately vertically on the curved sliding surfaces of the base plate. These projections act in the direction of external forces acting on the hinge parts which function to grip the sliding surfaces of the base plate tighter as the load increases. The base plate also has wedge surfaces at an end which come in contact with the associated incline contact surfaces of the mounting plate. These and other objects and advantages of the present invention will become more apparent after a consideration of the following detailed specification taken in conjunction with the accompanying drawings wherein like characters of reference designate like parts throughout the several views.

DESCRIPTION OF THE PREFERRED EMBODIMENT

Figure 1:
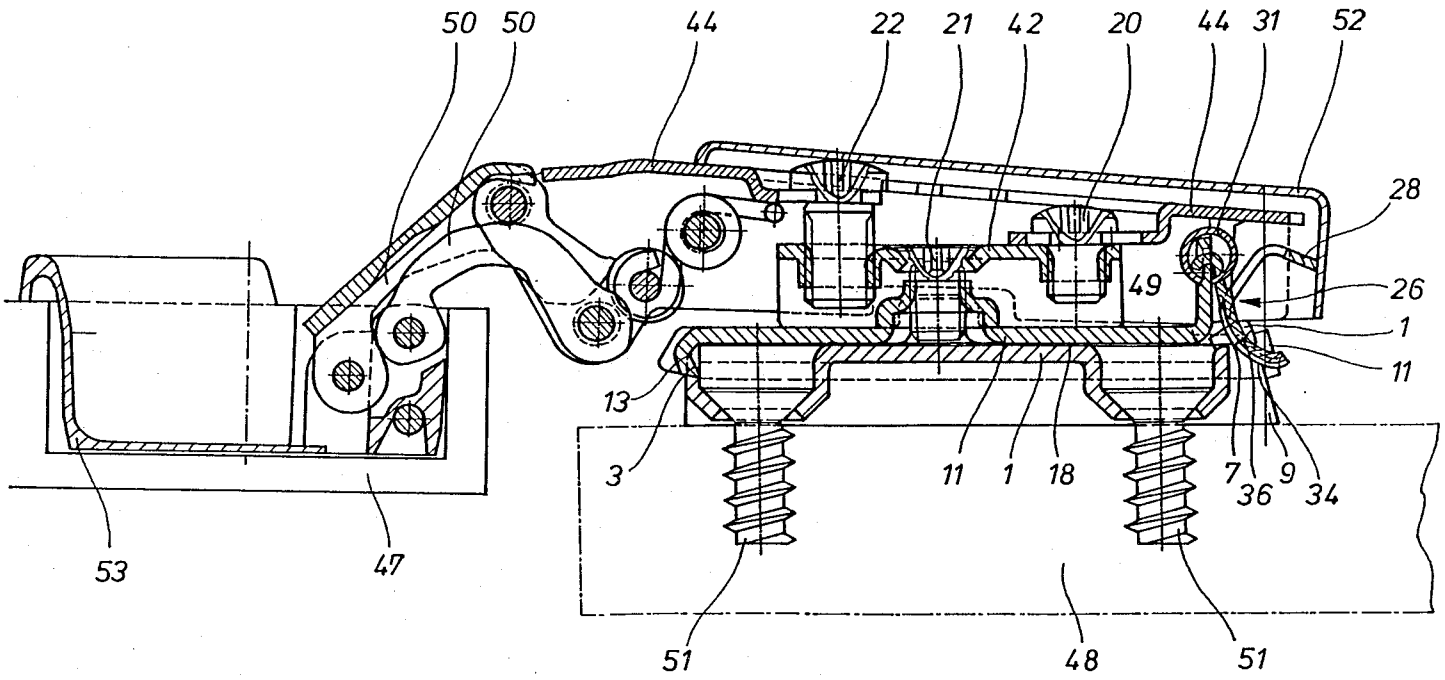
FIG. 1 is a side elevational sectional view of the furniture hinge comprising the present invention in the assembled condition.
Figures 2, 2A, 2B:
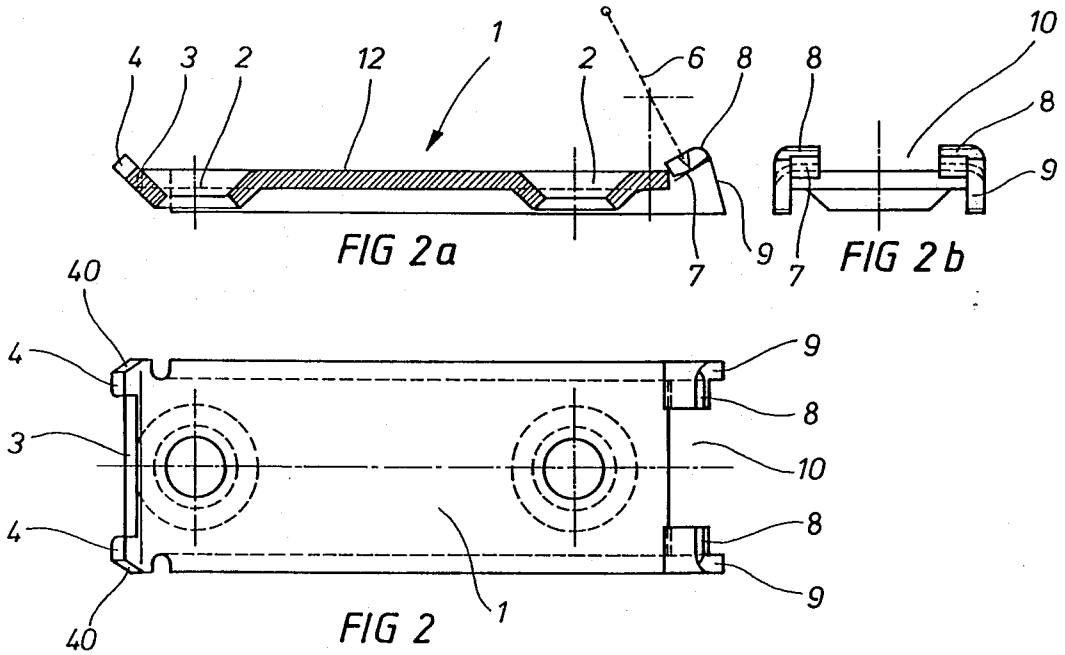
FIG. 2 is a plan view of the base plate of the present invention.
FIG. 2*a* is a side elevational sectional view of the base plate of the present invention.
FIG. 2*b* is a rear elevational view of the base plate of the present invention.
Figures 3, 3A, 3B:
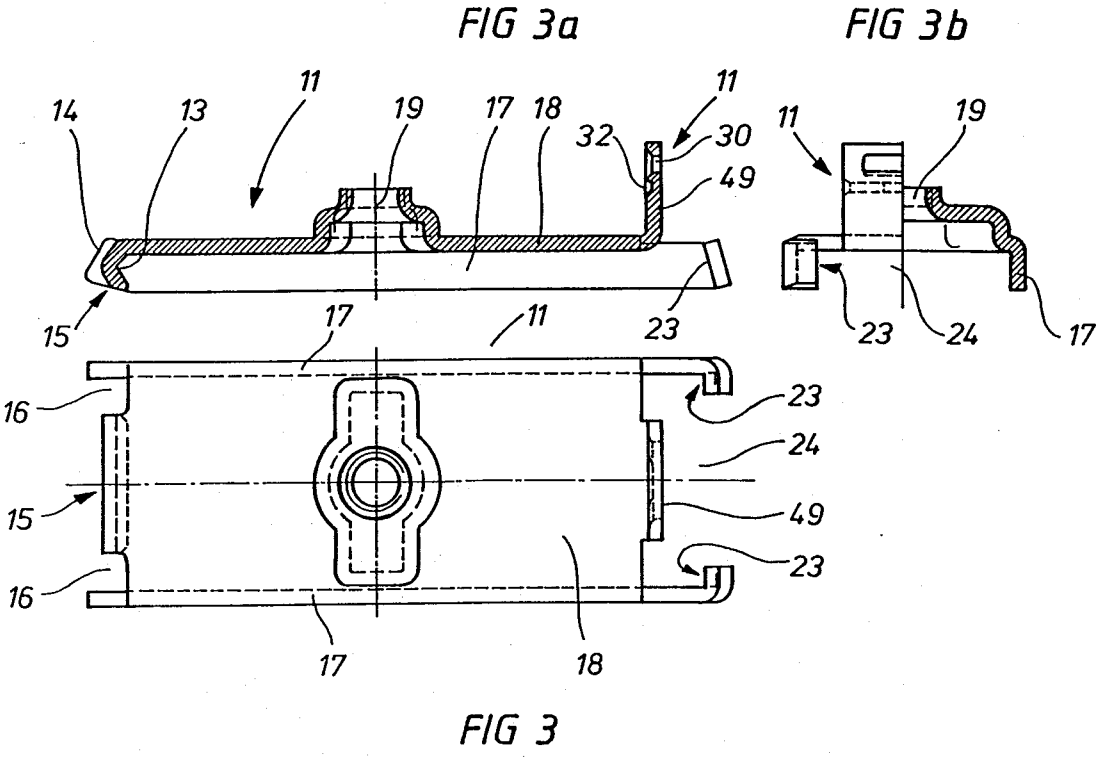
FIG. 3 is a plan view of the mounting plate of the present invention.
FIG. 3*a* is a side elevational sectional view of the mounting plate of the present invention.
FIG. 3*b* is a rear elevational and cross-sectional view of the mounting plate of the present invention.
Figure 4B:
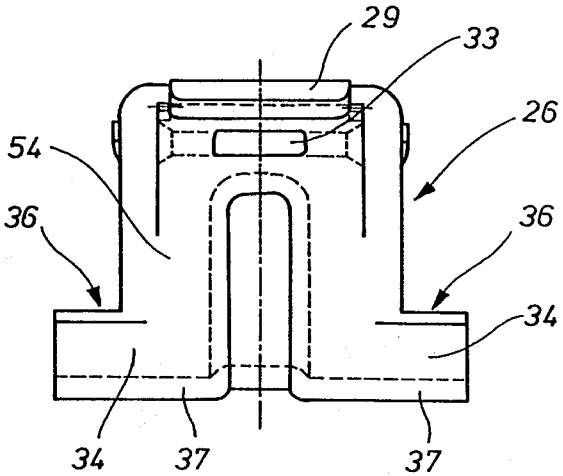
FIG. 4*b* is a front elevational view of the rocker of the present invention.
Figure 4:
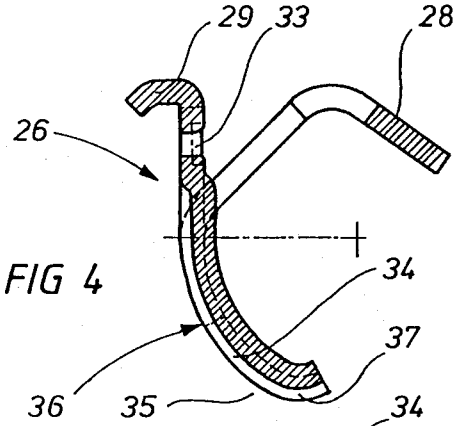
FIG. 4 is a side elevational sectional view of the rocker of the present invention.
Figure 4A:
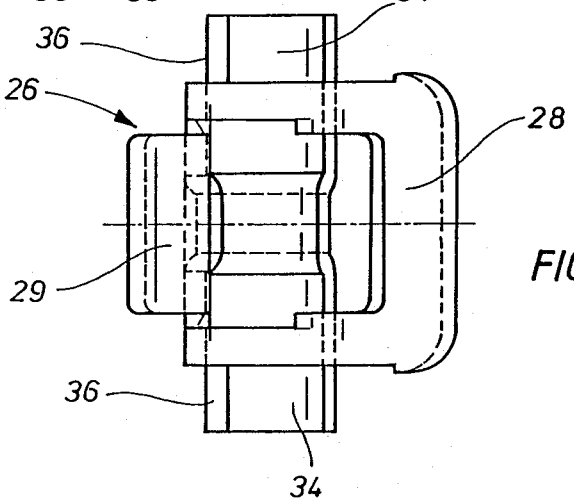
FIG. 4*a* is a plan view of the rocker of the present invention.
Figure 5:
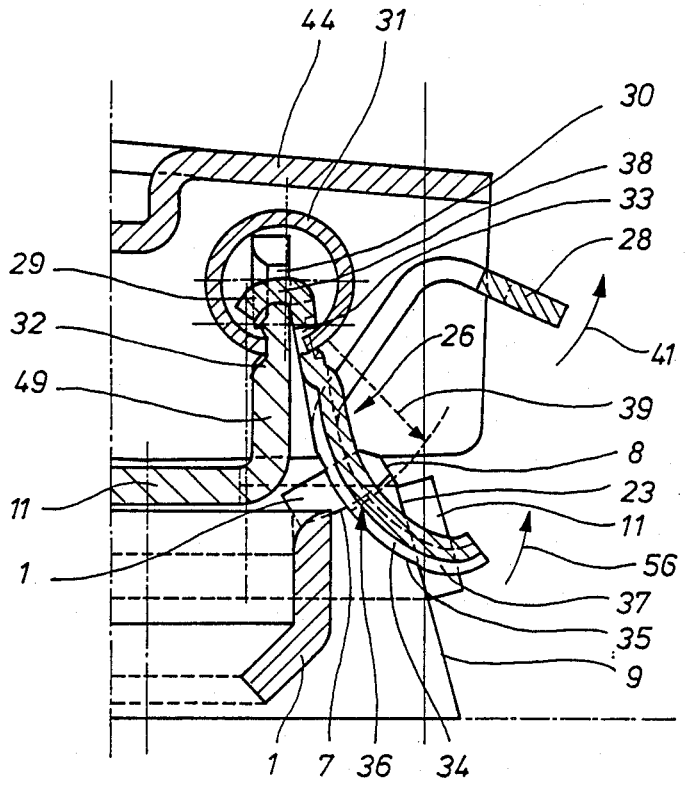
FIG. 5 is an enlarged, side elevational, sectional and fragmentary view showing the snap-in mechanism of the base and mounting plates over the rocker.
Figure 6B:
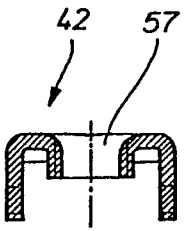
FIG. 6*b* is an end elevational sectional view of the adjusting plate of the present invention.
Figure 6A:
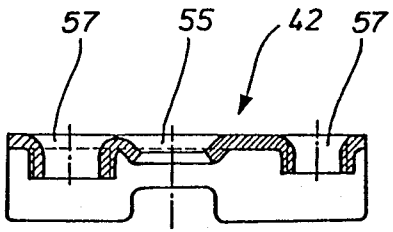
FIG. 6*a* is a side elevational sectional view of the adjusting plate of the adjusting plate of the present invention.
Figure 6:
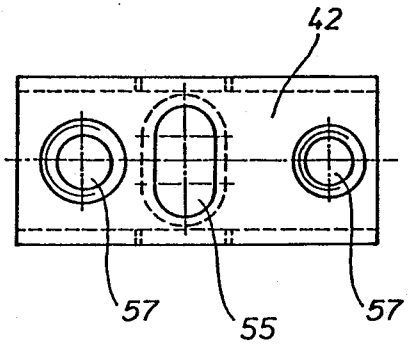
FIG. 6 is a plan view of the adjusting plate of the present invention.
Figure 7:
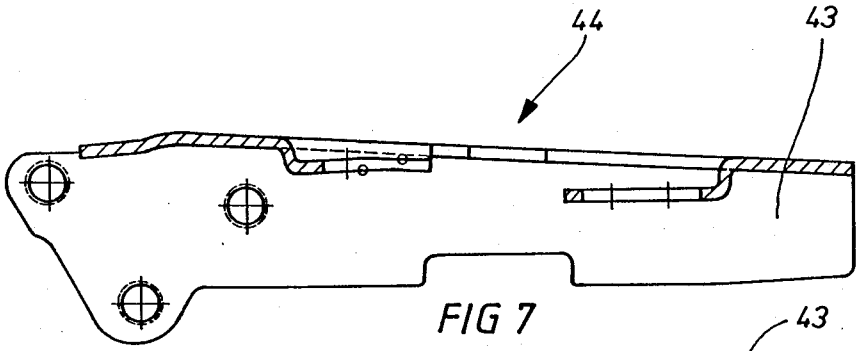
FIG. 7 is a side elevational sectional view of the cover bracket of the present invention.
Figure 7A:
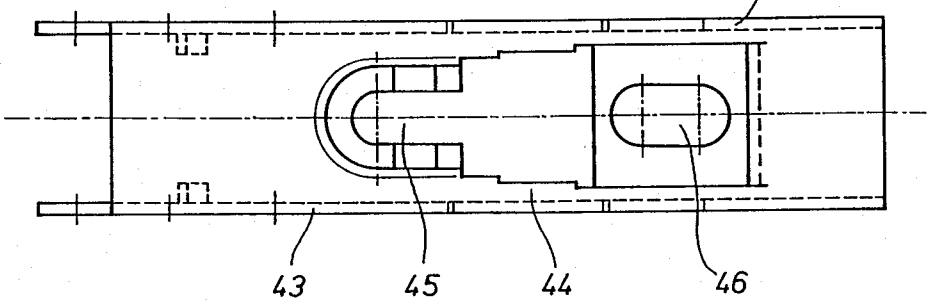
FIG. 7*a* is a plan view of the cover bracket of the present invention.
Figure 8:
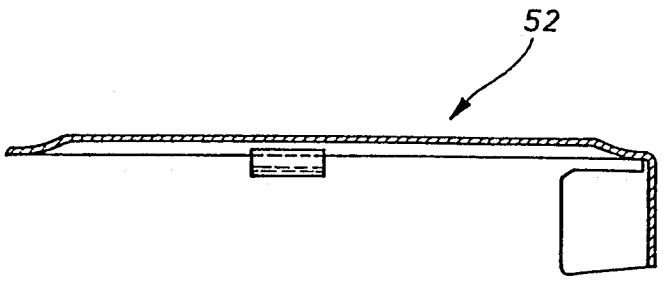
FIG. 8 is a side elevational sectional view of the protective cap of the furniture hinge comprising the present invention.

FIG. 1 shows a sidewall 48 of a furniture article and a part of the door 47 with the base plate 1 of the hinge comprising the present invention affixed to sidewall 48 by fastening screws 51. Base plate 1 is connected to the other hinge components, particularly mounting plate 11, so that the hinge fastens to base plate 1 in the manner hereinafter to be described.

An articulation housing 53 is anchored to door 47 and supports one or more swivel arms 50. Swivel arms 50 pivot within cover bracket 44, and an adjusting plate 42 is mounted thereon by means of adjusting and fastening screws 20 and 22. Cover bracket 44 has a lateral flange 43 which covers the hinge parts arranged on the inside.

Mounting plate 11 is connected to adjusting plate 42 by means of another adjusting and fastening screw 21. Door 47, articulation housing 53, swivel arms 50, cover bracket 44, adjusting plate 42, and mounting plate 11 make up a unit in the form of a hinge frame which is connected with base plate 1 affixed to furniture article 48.

Front area 14 of mounting plate 11 has an inwardly directed hook-like supporting surface 13 generally shaped like a hook and designated 15. On the opposite end, mounting plate 11 has an upwardly projecting wing 49 on which a rocker 26 is spring mounted by a bushing spring 31 which advantageously engages a slot 32 of wing 49.

Rocker 26 has offset locking shoulders 34 with lateral gripping and locking projections 36.

The rear area of base plate 1 has upwardly curved sliding surfaces 7 with a radius 6. It also has a sliding radius 8 on its front side.

The forward area of base plate 1 has an upwardly directed wedge surface 3 with lateral projections 4.

The hinge frame as a unit is now connected with base plate 1 through mounting plate 11. The hook-shaped supporting surface 13 of mounting plate 11 is hooked on two wedge surface 3 of base plate 1 in the forward area and projections 4 with bevels 40 of the base plate 1 advantageously slide along the flanges 17 of mounting plate 11 finally arrive in recesses 16 of mounting plate 11.

Rocker 26 is arranged on the rear area of mounting plate 11. When mounting plate 11 is locked onto base plate 1, rocker 26 first slides with the sliding surface 35 along the locking shoulders 34 on the sliding radius 8 of the sliding surfaces 7. In further interlocking, the gripping projections 36 come into contact from the bottom of the sliding surfaces 7 of the base plate 1. Connection of the hinge parts with base plate 1 is now established.

Rocker 26 passes through opening 30 in wing 49 of mounting plate 11 with an offset gripping wing 29 and is held in position by bushing spring 31 which engages slot 33. Rocker 26 is spring mounted on mounting plate 11 and, on upwardly curved wings 49, it forms a fulcrum 38 with a turning radius 39 of gripping projections 36 with placement on the curved sliding surfaces 7. The radius of curvature 6 of sliding surfaces 7 on base plate 1 is greater than the turning radius of the gripping projections 36 starting at fulcrum 38 of rocker 26. This achieves an advantageous self-locking with forces in the opening direction of the hinge. Projections 36 tightly grip sliding surfaces 7 and can be separated only by lifting actuating bracket 28 of rocker 26 in the direction of arrow 41.

For separation of rocker 26, offset shoulder 37 pivots in the direction of arrow 56. This lifts gripping projections 36 from sliding surfaces 7, and the hinge frame can be separated from base plate1 by unhooking at the wedge surface 3.

The gripping projections 36 of rocker 26 are set approximately vertically on the curved sliding surface 7 of base plate 1.

When the hinge parts are under load, the locking of gripping projections 36 to sliding surfaces 7 is enhanced. The end of base plate 1 has wedge surfaces 9 that come into contact with associated incline contact surfaces 23 on mounting plate 11. When mounting plate 11 is locked onto base plate 1, contact of wedge surface is 9 on contact surfaces 23 of mounting plate 11 is achieved. This causes additional wedging of mounting plate 11 on base plate 11 that advantageously resists any displacement of the hinge parts in the longitudinal direction.

In one embodiment, a rocker 26 is spring mounted, with a spiral or leg spring. Leaf springs or leg springs can also be arranged in the longitudinal direction to grip the hinge parts from the rear for interlocking.

The rear area of base plate 1 has a recess 10 between sliding surfaces 7 through which the neck 54 of rocker 26 passes on interlocking of base plate 1 with mounting plate 11. Rocker locking shoulders 34 with gripping projections 36 contact sliding surfaces 7 of base plate 1. Mounting plate 11 also has a recess 24 through which neck 54 and rocker 26 passes, the lateral wings forming contact surfaces on the rear end of mounting plate 11 in order to accept wedge surfaces 9 of base plate 1 as a tapering rear grip.

Mounting plate 11 has a smooth bottom surface 18 which lies flush against base plate 1 in order to transfer major forces.

Cover bracket 44 has openings 45 and 46 through which fastening and adjusting screws 20 and 22 pass and engage thread guides 57. The furniture hinge can be adjusted upwardly, downwardly and at an angle in a convenient manner by adjusting of screw 21 in opening 55 of adjusting plate 42. Mounting plate 11 is affixed to base plate 1 through adjusting and fastening screw 21 in thread guide 19.

Fastening and adjusting screws 20, 21 and 22 are covered by a protective cap 52 that is locked onto cover bracket 44 in the manner shown in FIG. 1.

Gripping projections 36 are positioned approximately vertically on sliding surfaces 7 of base plate 1. Gripping projections 36 point in the direction of fulcrum 38 of rocker 26, i.e., in the direction of a possible tensile load, the lever arms on the interlocked hinge parts thereby preventing separation thereof.

The hinge of the present invention functions so that the tension of the bushing spring 31 helps to achieve self-locking in the opening direction of gripping projections 36 on sliding surfaces 7. This provides for reliable interconnection of the hinge parts with a relatively low amount of design effort.

Assembly of the door 47 with the furniture article 48 is considerably facilitated by the near vertical fitting together of the hinge parts, particularly mounting plate 11 to base plate 1 on door 47. Expensive slot guides on the hinge parts are thereby eliminated.

What is claimed is:

1. A furniture hinge for mounting a door to an article of furniture comprising: an articulation housing mounted on the door; one or more swivel arms pivotally connected at one end to said housing; a cover bracket connected to the other end of said swivel arm; an adjusting plate secured to said cover bracket; a mounting plate secured to said cover bracket; a base plate mounted on the furniture article having an upwardly curved sliding surface, said mounting plate having a hook-shaped supporting surface and a spring-mounted rocker, said rocker having backwardly curved locking shoulders with gripping projections that lockably engage said base plate upwardly curved sliding surface thereby forming a snap-in mechanism for locking the door and components of the hinge onto the base plate, said mounting plate having a wing and an opening therein cooperatively receiving said rocker and said rocker has an offset gripping wing and a bushing spring holding said rocker in an engaged position with said gripping wing.

2. A furniture hinge as claimed in claim 1 wherein said rocker has an outwardly projecting actuating bracket.

3. A furniture hinge as claimed in claim 2 wherein the rocker gripping projections are set approximately vertically on the base plate curved sliding surfaces.

4. The furniture hinge as claimed in claim 1 wherein said base plate has wedge surfaces at one end and said mounting plate has inclined contact surfaces contacting said wedge surfaces.

5. The furniture hinge as claimed in claim 1 wherein said base plate has left and right projections and said mounting plate has recesses that cooperatively engage said projections.

6. The furniture hinge as claimed in claim 5 wherein said projections each have a bevel and said mounting plate has lateral flanges slidably engaging said bevel.

7. A furniture hinge as claimed in claim 6 wherein the front side of said sliding surfaces are designed as a sliding radius.

8. The furniture hinge as claimed in claim 1 wherein said rocker has a leg spring mounted on said mounting plate wing.

* * * * *